United States Patent [19]

Cox et al.

[11] 4,155,832

[45] May 22, 1979

[54] HYDROGENATION PROCESS FOR SOLID CARBONACEOUS MATERIALS

[75] Inventors: John L. Cox; Wayne A. Wilcox, both of Richland, Wash.

[73] Assignee: The United States of America as represented by the United States Department of Energy, Washington, D.C.

[21] Appl. No.: 863,765

[22] Filed: Dec. 23, 1977

[51] Int. Cl.[2] ..... C10G 1/06; C10G 1/00; C10C 3/02; C10G 23/06

[52] U.S. Cl. ..... 208/10; 208/11 R; 208/44; 208/56; 201/2.5

[58] Field of Search ..... 208/10, 11 R, 44, 56; 201/2.5

[56] References Cited

U.S. PATENT DOCUMENTS

| | | | |
|---|---|---|---|
| 2,639,982 | 5/1953 | Kalbach | 208/11 R |
| 3,407,134 | 10/1968 | Wunderlick et al. | 208/56 |
| 3,502,564 | 3/1970 | Hodgson | 208/10 |
| 3,514,394 | 5/1970 | Wilson, Jr. et al. | 208/10 |
| 3,532,617 | 10/1970 | Hodgson | 208/10 |
| 3,629,159 | 12/1971 | Gorin et al. | 208/10 |
| 3,769,198 | 10/1973 | Johanson et al. | 208/10 |
| 4,077,867 | 3/1978 | Aldridge et al. | 208/10 |
| 4,102,775 | 7/1978 | Quarderer et al. | 208/10 |

FOREIGN PATENT DOCUMENTS

| | | | |
|---|---|---|---|
| 427275 | 4/1935 | United Kingdom | 208/10 |

*Primary Examiner*—Delbert E. Gantz
*Assistant Examiner*—William G. Wright
*Attorney, Agent, or Firm*—Dean E. Carlson; Frank H. Jackson; Hugh W. Glenn

[57] ABSTRACT

Coal or other solid carbonaceous material is contacted with an organic solvent containing both hydrogen and a transition metal catalyst in solution to hydrogenate unsaturated bonds within the carbonaceous material. This benefaction step permits subsequent pyrolysis or hydrogenolysis of the carbonaceous fuel to form gaseous and liquid hydrocarbon products of increased yield and quality.

10 Claims, 3 Drawing Figures

HYDROGENATION PROCESS FOR SOLID CARBONACEOUS MATERIALS

CONTRACTUAL ORIGIN OF THE INVENTION

The invention described herein was made in the course of, or under, a contract with the UNITED STATES DEPARTMENT OF ENERGY.

BACKGROUND OF THE INVENTION

The present invention relates to methods for the benefaction, gasification and liquefaction of coal and other carbonaceous materials. The fuel materials contemplated include anthracite, bituminous and lignite coal along with other materials such as wood,, lignin, oil shale, tar sand, peat, solid petroleum residuals and various solid products derived from coal and other carbonaceous materials.

Previous methods for carrying out the processing of solid carbonaceous materials have employed solid catalysts of cobalt, iron, nickel, molybdenum and alloys such as cobalt-molybdenum. Since the coal or other carbonaceous material is also in solid form, it is difficult to obtain contact between the solid phases and the other reactants. Consequently, high temperatures have been used to break carbon to carbon bonds for hydrogen addition. This hydrogenolysis of the carbonaceous substrate can produce gaseous and liquid products.

In processes for the liquefaction of coal with a solid catalyst, organic liquids, often recycled product, are used as a media for catalyst-reactant contact. Hence these processes are characterized as heterogeneous catalytic reactions employing heterogeneous catalysts.

Various processes as the Bureau of Mines synthoil and others employ heterogeneous catalytic reactions in which hydrogen is reacted with materials within the coal at temperatures above about 400° C. and pressures of 100–250 atmospheres. These reaction conditions promote hydrogenolysis in which carbon to carbon bonds are broken and hydrogen is added. In addition, other atoms such as oxygen, nitrogen and sulfur found in the carbonaceous materials are converted to water, ammonia and hydrogen sulfide. To the extent that these reactions remove sulfur and other pollutants, they can be desirable but otherwise they can be a nonproductive consumption of hydrogen.

PRIOR ART STATEMENT

The following patents and publications relate to the technical field of the subject invention but do not disclose or make obvious the invention as claimed.

U.S. Pat. No. 4,011,153 discloses a process for desulfurizing and liquifying coal by heating it to a temperature of 375° to 475° C. at pressures of 1500 to 5000 psig. This patent shows the use of an alkali metal catalyst dissolved in a oil slurry and a transition metal catalyst impregnated into a solid alumina substrate.

U.S. Pat. No. 3,687,838 to Seitzer discloses a process for dissolving bituminous coal by heating it in a hydrogen donor oil with carbon monoxide, water and an alkali metal or ammonium molydate catalyst at a temperature of about 400°–450° C. and a pressure of at least about 4,000 psig. The molybdate catalyst is dissolved in water and added to the mixture.

ERDA 77-33, "Fossil Energy Research Program of the Energy Research and Development Administration FY 1978", pages 33–47. This report summarizes the H-Coal, Synthoil and other coal liquefaction processes.

These processes employ solid catalysis as a bed or a slurry within hydrogenolysis reactors.

Weber and Falbe, "Oxo Synthesis Technology", *Industrial and Engineering Chemistry,* Vol. 62, No. 4, pages 33–37, April 1970. This report discloses the Oxo synthesis in which a homogeneous catalyst is used to hydrocarbonylate olefins to alcohols and aldehydes by reaction with a $H_2/CO$ mixture at about 200° C. and 200 atm pressure. The reactants, products and catalysts are generally in liquid phase requiring involved thermal decomposition or liquid extraction steps for catalyst recovery. Other aspects of the oxo process are disclosed in Kyle, *Kirk-Othmer Encyclopedia of Chemical Technology,* 2d Ed, Vol. 14, pages 373–389 (1967) and Forster and Roth, *Homogeneous Catalysis*-II, pages 19–26 (ACS 1974).

None of the above references disclose or make obvious the novel process disclosed herein in which a transition metal catalyst is dissolved within an organic solvent through use of a molecular coordination complex for the hydrogenation of a solid carbonaceous material. This aspect of applicants' invention permits the catalyst to penetrate into and be taken up by the organic substance within coal or other solid carbonaceous material and thus act as a homogeneous type of catalyst for the hydrogenation of solid carbonaceous substrates.

SUMMARY OF THE INVENTION

Therefore in view of the problems associated with the prior art processes, it is an object of the present invention to provide a process for hydrogenating solid carbonaceous materials with a transition metal catalyst in organic solution.

It is a further object to provide a hydrogenation method for solid carbonaceous materials that can be performed at moderate conditions.

It is also an object of the present invention to provide a process employing a hydrogenation catalyst in an organic phase that can penetrate organic carbonaceous phases of the substrate material.

In accordance with the present invention, solid carbonaceous material containing unsaturated carbon to carbon bonds is contacted with an organic solution containing a dissolved transition metal catalyst and available hydrogen. The transition metal is selected from rows 1, 2 or 3 of group VIII of the periodic table and is provided in solution within the solvent as a molecular complex. The organic solvent penetrates the carbonaceous material and transports the catalyst and hydrogen to the unsaturated carbon bonds.

In more specific aspects of the invention, the solid carbonaceous material is contacted with the transition metal catalyst solution at moderate conditions including temperatures less than 350° C. The catalyst and solid hydrogenated material are separated in a liquid-solid separation step. The transition metal catalyst is preferably in the form of a complex molecule containing ligands such as carbonyls, hydrocarbonyls, or those present in a Zeigler catalyst form each having a hydrogen incorporation capability. Hydrogen for the reaction can be supplied as a separate gas or in a mixture of gases including such as carbon monoxide from char gasification.

BRIEF DESCRIPTION OF THE DRAWINGS

The present invention is illustrated in the accompanying drawings wherein

FIG. 3 is a schematic flow diagram of a hydrogenation and hydrogenolysis process for the liquefaction of solid carbonaceous material.

DETAILED DESCRIPTION OF THE PREFERRED EMBODIMENT

Figure 1:
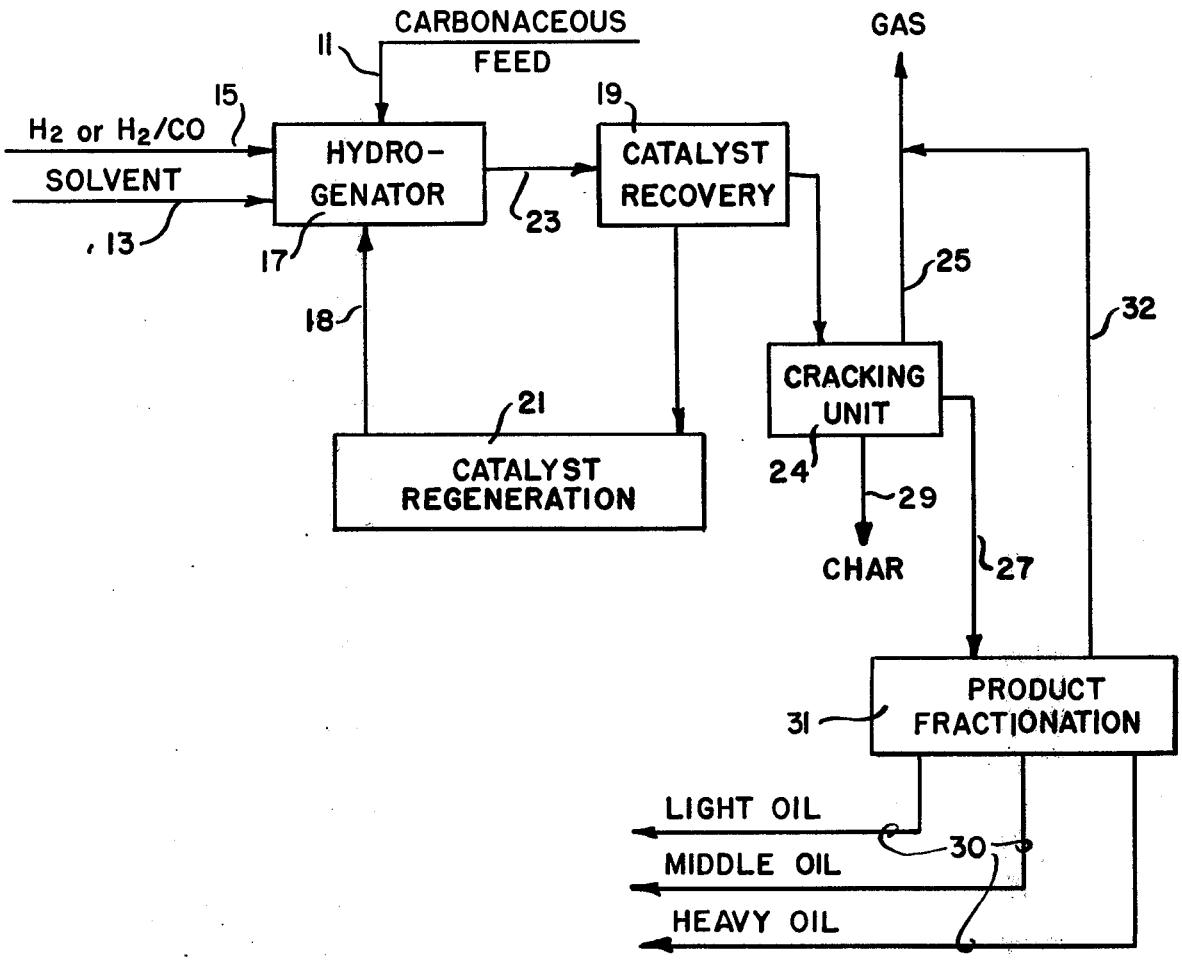
FIG. 1 is a diagrammatic flow diagram of a hydrogenation process for solid carbonaceous fuel.

FIG. 1 illustrates a diagrammatic presentation of the process of the present invention. A solid carbonaceous feed material 11 passes into a reactor 17 where it is contacted with a solvent 13 containing a catalyst and with a source of hydrogen 15. Hydrogen can be made available as hydrogen gas or as hydrogen and carbon monoxide gas.

The catalyst is dissolved in the solvent 13 in the form of a complex molecule. Most of the catalyst will track with the solvent in a catalyst recovery operation 19 involving a liquid-solid separation. Where necessary, suitable catalyst regeneration can be performed at 21 as dictated by the particular process. The catalyst and solvent at 18 are recycled into the hydrogenator 17 for further rection with the carbonaceous feed.

Following the hydrogenation step the hydrogenated carbonaceous material can be further processed by thermal or catalytic cracking as at 24 to produce separate streams of gas 25, liquid 27 and solid char 29. Each of these streams can include hydrocarbons and other carbonaceous material. The liquid product can be distilled as illustrated by the fractionation operation 31 to provide various product fractions of liquids 30 and gases 32.

The solvent 13 selected for use can be one or more of a large number of well known organic solvents which have sufficiently high boiling points to be in liquid phase at the reaction conditions. The liquefaction products of the coal or other solid carbonaceous material may well be quite suitable and economical for selection. The solvent must be one which can take into liquid solution the selected catalyst complex. Typically saturated or nearly saturated organic liquids including both cyclic and acyclic liquids can be considered. The selection of an unsaturated organic liquid material may merely result in its saturation during the hydrogenation process with nonproductive consumption of hydrogen. However, the less reactive aromatics such as the alkyl benzenes may be suitable solvents. Solvents such as the alkanes, of 7 or more carbon atoms, cyclic compounds such as decalin, tetralin, cyclohexane, tetrahydrofuran (THF) and mixtures of these materials can be used. The light oil fraction from the liquefaction of coal can include napthalene, methylindan, benzene, $C_4$-benzene, and decalin. Such a light oil mixture possibly including other organic liquids is expected to provide a suitable solvent.

The catalyst selected for use will be one that can be dissolved within the liquid organic solvent. The first, second and third row transition metals of group VIII (Fe, Ru, Os, Co, Rh, Ir, Ni, Pd, and Pt) are contemplated. The metals are combined into an organometallic complex including coordinated ligands such as carbonyls, hydrocarbonyls and other ligand groups which impart solubility to the transition metal within the solvent. One other group of complexes which were found suitable are the transition metal Ziegler catalysts. These catalysts are prepared through the reaction of a transition metal carboxylate with an alkyl aluminum within an anhydrous organic solvent. As an example, triethyl aluminum reacted with a nickel naphthenate in n-heptane provides a usable form of this catalyst. Various other transition metal carboxylates including the benzoates, oxalates, acetates, etc. can be reduced within the alkyl aluminum to form various and known Ziegler-type catalysts. It is desirable that the organic acid group impart solubility to the carboxylate and the transition metal Ziegler catalysts in the organic solvents used.

A number of other molecular complexes that have been found to be active olefin hydrogenation catalysts are also contemplated. These include Vaska's compound $[Ir(CO)_3(Ph_2P)\ Cl]$, and complexes of Co(I), Pt(II) and Fe(O) and metalogenzymes such as the Rh(I) complex with N-Phenylanthranilic acid.

Catalyst recovery can be obtained by separating the solid carbonaceous material from the solvent solution of the catalyst following the hydrogenation reaction. It has been found that at least $\frac{2}{3}$ of the catalysts will pass with the solvent. This recovery yield can be increased by a number of techniques such as by washing the hydrogenated, carbonaceous material with small additions of solvent. However, it may be advantageous for a small portion of the catalyst to enter the subsequent pyrolysis, hydrogenolysis or catalytic cracking operations in order to promote liquefaction.

The thermal or catalytic cracking operation 24 can also be provided with a source of hydrogen gas to permit the hydrogenolosis of the carbonaceous material. Hydrogen with carbon monoxide can be provided through a separate gasification process in which the char solids leaving the cracking unit are gasified by contact with steam and oxygen. Hydrogen for use in the original hydrogenator can also be provided in this manner. The carbon monoxide included with the hydrogen gas stream can result in some carbonylation of the product fuel. The liquid product fractionation can be performed by well-known distillation techniques as illustrated at 31. The products are separated by boiling points into the various liquid fractions 30 and gases 32.

The mechanism for the process of the present invention is not specifically understood. However, it is believed that the transition metal is in the organic solvent as a complex molecule with coordinated ligands, for instance, as dicobaltoctacarbonyl within decalin solvent. It is known that molecular hydrogen will undergo oxidative addition reactions with such transition metal complexes as follows:

$$L_nM + H_2 \rightarrow L_nMH_2$$

where L are the ligands and M is the transition metal. The hydrogenated complex molecule then combines with an aromatic molecule within the solid carbonaceous fuel, for instance, with polymerized, condensed or other solid forms of materials related to naphthalene, anthracene, perulene, pyrene, triphenylene, chrysene and phenanthrene. The combination results in the loss of at least one of the coordinated ligands. The hydrogen from the catalytic complex may then migrate and combine at one of the double bonds within the aromatic molecule. The recovery of a ligand onto the complex can release additional hydrogen for double bond saturation. Subsequent hydrogenation of the transition metal complex can begin the cycle again, resulting in further hydrogenation of the aromatic material.

In order to illustrate the increase in the hydrogen to carbon ratio (H/C) various coals were hydrogenated with either $H_2$ or with 75% $H_2$, 25% CO gas. The coal samples were comminuted to about −200 mesh U.S. sieve series and transition metal catalysts were provided as complex molecules with coordinated ligands dissolved in the indicated organic solvent. The nickel-Ziegler catalyst was prepared under a nitrogen atmosphere by reacting 4 moles of triethyl aluminum with one mole of nickel napthenate within anhydrous n-heptane. The results are reported in Table I as the change (Δ) in H/C respecting coal feed and solid product.

TABLE I

| Catalyst/Feed[a]/Solvent | Temp./Pres.[d]/Time[b] | Product Composition H | C | At.H/C | Δ(atomic H/C) |
|---|---|---|---|---|---|
| No catalyst/15 g c/decalin | 300/2880/2 | 4.64 | 68.6 | 0.806 | −0.003 |
| 14 mmole $Co_2(CO)_8$/30g c/decal in | 200/2950[e]/2 | 4.69 | 67.4 | 0.0.829 | 0.020 |
| 7 mmole $Co_2(CO)_8$/15 g c/decal in | 300/3080[e]/2 | 5.16 | 69.0 | 0.891 | 0.082 |
| 7 mmole $Co_2(CO)_8$/15g c/decal in | 400/3400[e]/2 | 5.26 | 71.8 | 0.873 | 0.064 |
| 13 mmole $Fe_3(CO)_{12}$/30g c/decal in | 200/2830[e]/2 | 4.56 | 65.9 | 0.824 | 0.015 |
| 7 mmole $Ni[(CO)_3P]_2CO)_2$/15g g c/decal in | 200/2720[e]/2 | 4.94 | 70.7 | 0.833 | 0.021 |
| 7 mmole Ni-Ziegler/15g c/decal in | 200/2770/2 | 4.48 | 55.8 | 0.957 | 0.148 |
| 8 mmole Ni-Ziegler/15 g g c/heptane | 200/1300/22 | 5.88 | 63.6 | 1.10 | 0.291 |
| 8 mmole NI-Ziegler/10g SRC/THF | 200/1200/23 | 7.29 | 77.1 | 1.13 | 0.377 |
| 5.7 mmole Ni-Ziegler/17.2g COED/THF | 200/2850/21 | 8.28 | 74.8 | 1.32 | 0.290 |

[a]Feed materials include: Consolidation coal (c), 4.64%H, 68.3%C, At.H/C = 0.809; Solvent Refined Coal (SRC), 5.55%H, 87.7%C, At.H/C = 0.753; FMC pyrolasate (COED), 7.32%$H_2$, 85.0%C, At.H/C = 1.03.
[b]Variables temperature, pressure and time reported as ° C. psig and hr., respectively.
[c]Δ, is change in atomic H/C ratio between substrate and solid product.
[d]Pressures are those at reaction temperature and due to hydrogen and solvent unless otherwise stated.
[e]Gas composition of 25% CO, 75% $H_2$, used in hydrogenation.

In each of the tests other than the one conducted at 400° C. nearly all of the carbonaceous material of the coal was recovered as solid glossy black material with little increase in the volume of the solvent. Hydrogenation at 400° C. produced a black viscous liquid. It is expected that at temperatures of 400° C. and above the carbonaceous material within the coal undergoes hydrogenolysis of carbon to carbon bonds resulting in lower molecular weight compounds that enter the liquid and gaseous phases. This is undesirable as it does not permit ready separation of the catalyst from the coal products in a solid-liquid-type separation.

In another comparative test, middle Kittanning coal having an H/C ratio of 0.883 was contacted with a solid cobalt-molybdenum catalyst in slurry with recycle oil solvent. It was found that at 450° C., 2000 psi hydrogen pressure and 15 min contact time a decrease of 0.118 in the H/C ratio resulted.

Figure 2:
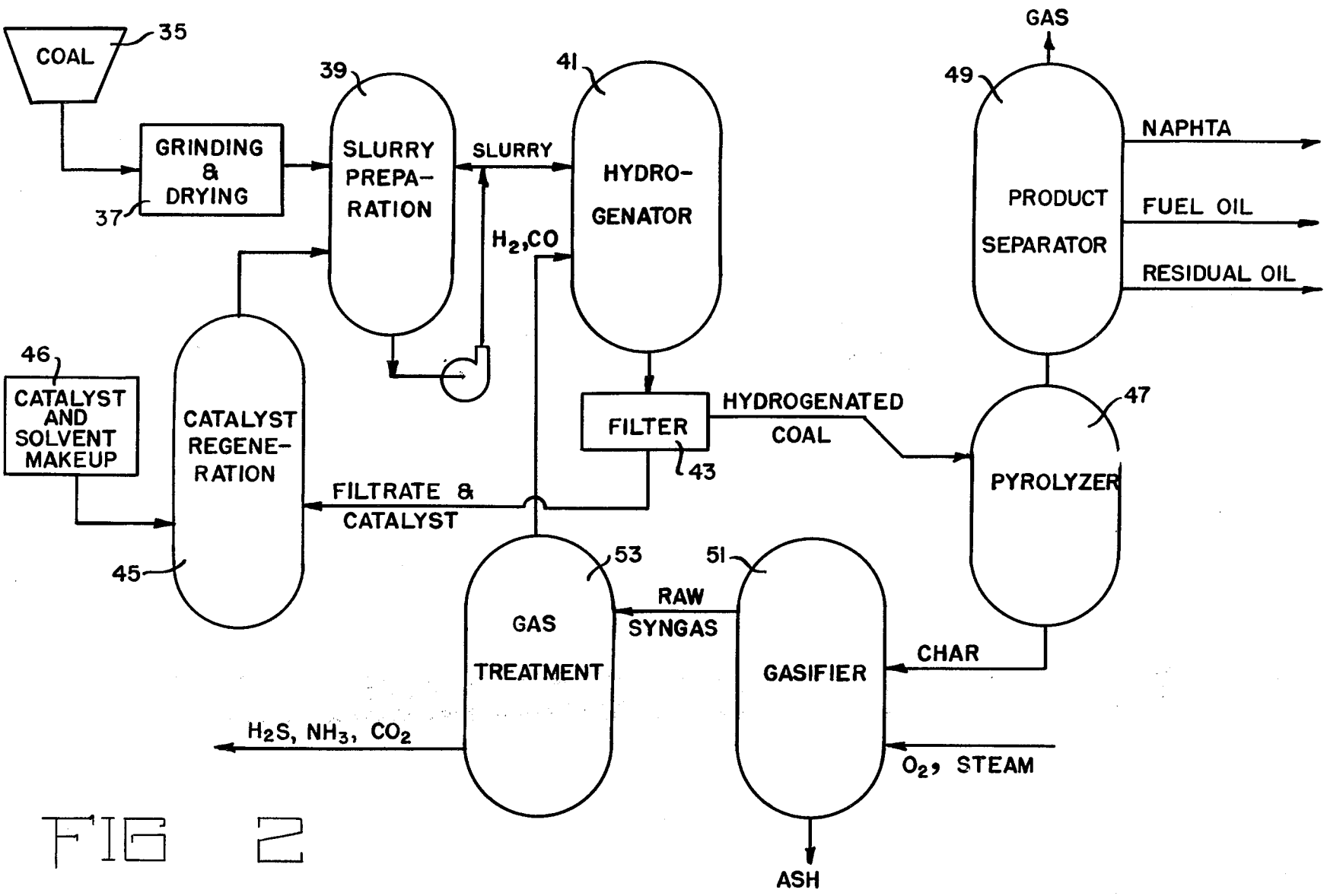
FIG. 2 is a schematic flow diagram of a hydrogenation and pyrolysis process for the production of liquid and gaseous hydrocarbons.
Figure 5:
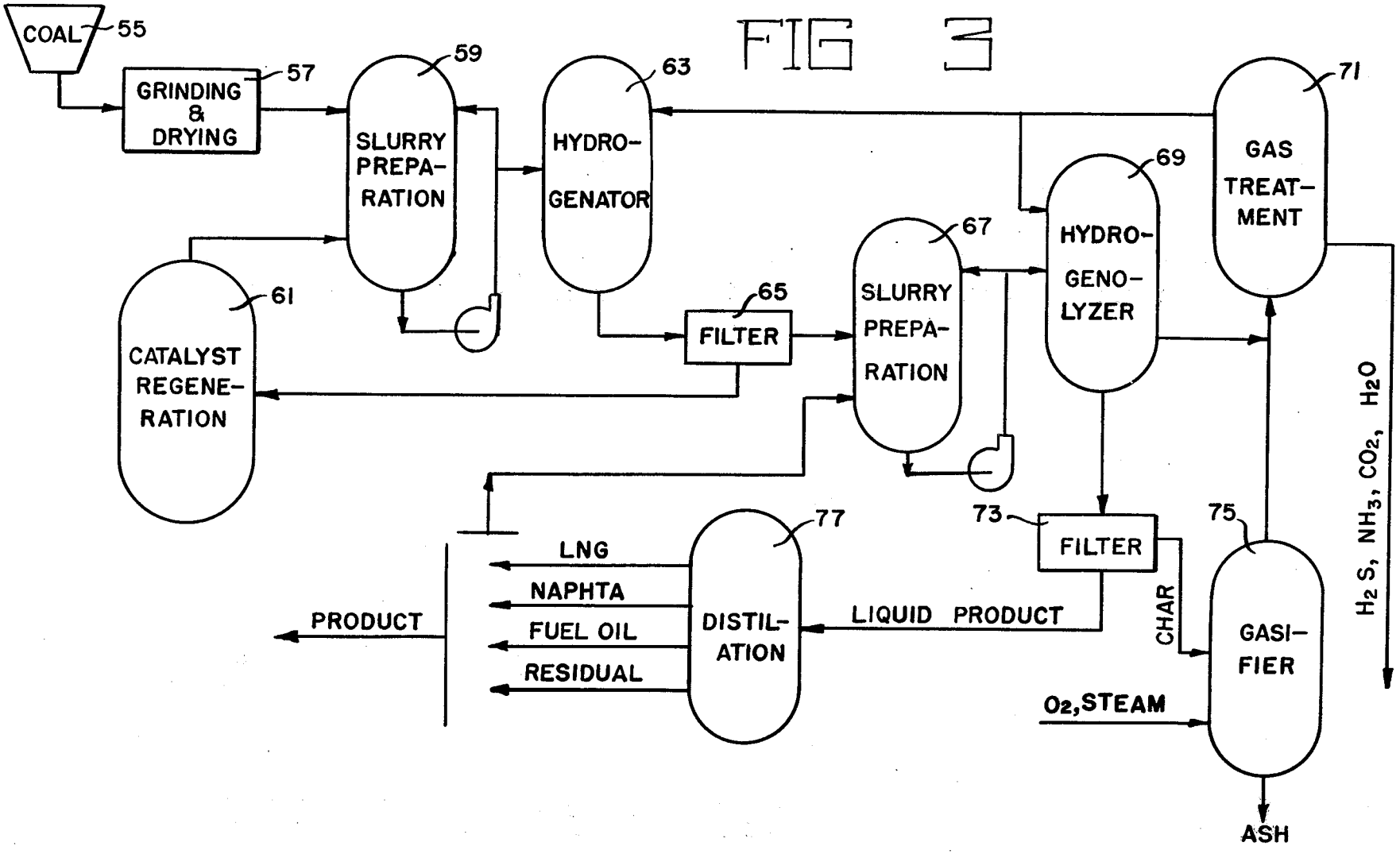

Referring now to FIG. 2 where a detailed schematic of one embodiment of the present process is presented. Coal from 35 is ground to a suitable size, for instance, about −200 U.S. sieve series mesh in known grinding and drying equipment 37. The pulverized coal is slurried with solvent in a mixing vessel 39 and transferred into the hydrogenator 41 for reaction with a source of hydrogen gas. A transition metal catalyst in the form of an organometallic complex is included within the solvent solution.

The hydrogenator 41 is preferably operated at a temperature of about 150° to 350° C. and at a pressure of in the range of 50 to 300 atms. Hydrogen gas or a combination of hydrogen and carbon monoxide gas obtained from a coal or char gasifier is passed into the agitated slurry within the hydrogenator 41.

Following the hydrogenation reaction, the solid, hyrogenated coal is separated from the liquid solvent within a conventional filter 43 and transferred to a pyrolyzer reaction vessel 47.

The filtrate from filter 43 containing the solvent and catalyst is passed through a catalyst regeneration process 45 in preparation for another charge of coal slurry. Regeneration can be accomplished by the addition of more catalyst and solvent as at 46 or by reaction with $H_2$ and CO for the regeneration of transition metal carbonyls. As an alternate feature, fresh solvent can be used following the filtering operation to wash additional catalyst from the hydrogenated coal.

Within the pyrolyzer reactor 47 the hydrogenated coal is heated to a temperature of in the range of 400°–700° C. at about 1 atms. pressure. This breaks carbon to carbon bonds and converts much of the solid carbonaceous material to gas and liquid product. The product can be further separated in a distillation process 49 into a gas phase containing various low-molecular weight hydrocarbons, carbon monoxide and hydrogen as well as various liquid fractions of naphtha fuel oil and residual oil. These product fractions can include both cyclic and acyclic hydrocarbons and other carbonaceous liquids.

The remaining char including residual, carbonaceous material, can be transferred to gasifier 51 for conventional gasification with oxygen and steam at elevated temperatures, e.g. 700° C. to produce additional synthesis gas. This gas can be treated for removal of sulfur, ammonia and carbon dioxide in the gas separation and treatment process 53. Well-known processes such as the Rectisol or Benifield Process can be employed to provide a hydrogen and carbon monoxide gas mixture for use in the catalystic hydrogenator 41. In such gas treatment operations the acid gases are removed by contact with liquid amines, for instance wit ethanol amine.

Yet another process illustrating the present invention is shown in FIG. 3. Coal feed 55 is ground at 57 and fed into a vessel 59 for preparation of a slurry with a coal derived organic solvent. The slurry including the transition metal catalyst as a complex molecule in solution is fed into the hydrogenator 63 where it is reacted with hydrogen gas and subsequently separated from the solvent by filter 65. The recycled catalyst and solvent are suitably treated at 61 as in the previous process of FIG. 2.

The hydrogenated coal is again slurried in agitated vessel 67 with a coal derived solvent and fed into a second reactor 69 where it is again contacted with additional flow of hydrogen gas at an elevated temperature of 400°-500° C. and at a pressure of 100 to 200 atms. In this hydrogenolyzer 69 the hydrogen gas reacts to break carbon-to-carbon bonds within the coal and thereby form substantial amounts of liquid and gaseous products. The gaseous products can be treated in gas treatment 71 for removal of sulfur, hydrogen sulfide, ammonia, carbon dioxide and water. The liquid products in slurry with remaining solid material pass through a second filter 73 where the solid char is removed for gasification at 75. Filtrate from filter 73 is separated into various liquid fractions including liquid $C_2$-$C_4$ products (LNG), naphtha, fuel oil and residual heavy oils within distillation operation 77. The various fractions are used as needed for makeup solvent for the process or as product.

In order to illustrate the improvement in hydrogenolysis yield and quality through use of a preliminary hydrogenation of the solid material, two similar feed materials were processed. Hvab coal having an analysis of 1.1% moisture, 14.5% ash, 4.8% H, 68.8% C, 6.09% O, 1.2% N and 4.6% S was comminuted to −200 U.S. sieve series mesh for each of the samples. One sample was first hydrogenated at about 200° C. with a nickel-Ziegler catalyst in tetralin for about 2 hours. Both samples were then subjected to similar hydrogenolysis. A Co-Mo solid catalyst was used with the control coal sample but no additional catalyst was employed with the hydrogenated coal. However, about 0.12 g of nickel from the Ziegler catalyst remained on the hydrogenated material. The hydrogenolysis process conditions and products are given in Table II.

TABLE II

| | Hvab coal | Hydrogenated coal |
|---|---|---|
| Reaction Conditions | | |
| feed, g | 10.0 | 10.0 |
| tetralin, g | 30.0 | 30.0 |
| catalyst, g | 0.5 | none |
| temperature, ° C. | 400 | 400 |
| pressure, psig | 2660 | 2770 |
| time, hr | ½ | ½ |
| Conversion, % | 90.0 | 88.9 |
| Product Yields, % | | |
| gas | 26.7 | 48.6 |
| oil | 57.4 | 58.2 |
| light oil | 47.4 | 54.8 |
| asphaltenes | 10.0 | 3.4 |
| char | 10.1 | 11.1 |
| Gas Composition, mole % | | |
| $H_2$ | 91.2 | 87.7 |
| $CO_2$ | 0.5 | 0.4 |
| $C_2H_4$ | trace | trace |
| $C_2H_6$ | 2.4 | 2.6 |
| $O_2$ | trace | 0.3 |
| $N_2$ | 0.5 | 2.5 |
| $CH_4$ | 4.1 | 3.9 |
| CO | 0.1 | 0.2 |
| $C_3H_8$ | 1.3 | 2.3 |
| $C_4H_{10}$ | 0.2 | 0.1 |

It can be seen from the results that the hydrogenated coal sample produced an increased yield of gas and light oil over the control. More important, the significantly lower asphaltene yield for the hydrogenated sample illustrates the improvement in product quality. Asphaltenes are objectionable polynuclear aromatic compounds that have poor burning characteristics, deposit graphite like carbon and may be carcinogenic.

The present invention has been described in terms of several specific embodiments. However, it will be clear to one skilled in the art that variations can be made in process conditions including temperatures, pressures and times as well as in the various process materials in accordance with the invention as defined in the claims.

The embodiments of the invention in which an exclusive property or privilege is claimed are defined as follows.

1. A method of hydrogenating solid carbonaceous fuels that contain unsaturated carbon to carbn bonds, the carbonaceous materials are selected from coal, lignite, wood, lignin, oil shale, tar sand, peat, and solid petroleum residuals comprising providing an organic solution containing a nickel Zeigler catalyst prepared from a nickel carboxylate reacted with an alkyl aluminum in an anhydrous, organic solvent to provide a homogeneous catalytic solution;

treating the catalytic solution with a source of hydrogen to form a hydrogen-containing complex with the transition metal; and contacting the solid carbonaceous material with the catalytic solution to hydrogenate the unsaturated carbon bonds.

2. The method of claim 1 wherein the solid carbonaceous fuel is contacted with the catalytic solution at a temperature less than 400° C.

3. The method of claim 2 wherein the temperature is between 150° C. to 350° C.

4. The method of claim wherein the hydrogenated, solid, carbonaceous material is separated from the catalytic solution by a liquid-solid separation.

5. The method of claim 1 wherein the organic solution includes a liquid solvent of liquefaction products of the solid carbonaceous material.

6. The method of claim 1 wherein the solid carbonaceous material following the hydrogenation reaction is heated to a temperature substantially in excess of 300° C. to produce gaseous and liquid hydrocarbon products.

7. The method of claim 6 wherein the solid, hydrogenated carbonaceous material is heated to a temperature of about B 400°-500° C. at about 100-200 atmospheres pressure in the presence of a transition metal catalyst and a source of hydrogen to provide hydrogenolysis of the carbonaceous material resulting in gaseous hydrocarbons, liquid hydrocarbon and solid char containing residual carbonaceous material.

8. The method of claim 7 wherein the solid char containing residual carbonaceous material is contacted with steam and oxygen to produce a gas containing hydrogen and carbon monoxide as a source of hydrogen for treating the catalytic solution.

9. A method of converting solid carbonaceous material, that includes unsaturated carbon to carbon bonds, selected from coal, lignite, wood, lignin, oil shale, tar sand, peat and solid petroleum residuals to liquid and gaseous hydrocarbon fuels comprising:

contacting said solid carbonaceous material with a liquid catalytic solution in the presence of a source of hydrogen at a first temperature below 350° C. to hydrogenate unsaturated carbon bonds within the solid carbonaceous material, said catalytic solution including an organic solvent and a complex compound selected from the group consisting of the carbonyls, hydrocarbonyls and Ziegler-type catalytic compounds of the group VIII transition metals;

separating said liquid catalytic solution from said hydrogenated, solid carbonaceous material, and recycling said catalytic solution with dissolved catalyst into contact with fresh carbonaceous material;

heating said hydrogenated, solid carbonaceous material to a second temperature in excess of said first temperature in the presence of a hydrogen containing gas to break carbon to carbon bonds and form liquid and gaseous hydrocarbon fuels.

10. The method of claim 9 wherein said first temperature is between 150° C. and 350° C.

* * * * *